US006378696B1

(12) United States Patent
Smouha

(10) Patent No.: US 6,378,696 B1
(45) Date of Patent: Apr. 30, 2002

(54) DUAL PURPOSE DISPLAY CASE FOR WRIST WATCH AND OTHER JEWELRY

(75) Inventor: Joseph Smouha, New York, NY (US)

(73) Assignee: A Classic Time Watch Co., Inc., New York, NY (US)

( * ) Notice: Subject to any disclaimer, the term of this patent is extended or adjusted under 35 U.S.C. 154(b) by 0 days.

(21) Appl. No.: 09/611,915

(22) Filed: Jul. 7, 2000

(51) Int. Cl.[7] ..... B65D 85/40
(52) U.S. Cl. ..... 206/18; 206/6.1; 206/308.1
(58) Field of Search ..... 206/6.1, 18, 301, 206/308.1, 748, 776, 777

(56) References Cited

U.S. PATENT DOCUMENTS 1,752,246 A * 3/1930 Flier ..... 206/18
4,011,942 A * 3/1977 Crossien ..... 206/777
4,261,461 A * 4/1981 Kiziauskas ..... 206/776
5,590,767 A * 1/1997 Li ..... 206/208.1
5,682,987 A * 11/1997 Herzog ..... 206/301
6,024,215 A * 2/2000 Leung ..... 206/308.1

* cited by examiner

*Primary Examiner*—David T. Fidei
(74) *Attorney, Agent, or Firm*—Bernard Malina; Malina & Wolson

(57) ABSTRACT

A display case for jewelry, such as a wrist watch, is provided which includes a housing formed of a receiving shell and a cover closeable over the shell, a display mount within the housing for supporting the jewelry, and a multi-tiered rack within the housing adjacent the display mount. The preferred embodiment employs a foamed structure to serve as a mount which includes an outer frame surrounding a cavity and a support upon which the wrist watch rests and can form-fittingly be lodged within the cavity. The multi-tiered rack has a series of plates pivotally moveable from a horizontal to a vertical position. A CD disc can be stored within the pocket of each plate. When the primary purpose of the display case for showcasing jewelry has been completed, a purchaser of the jewelry discards the foamed mount and can now employ the case for the storage of CD discs.

12 Claims, 3 Drawing Sheets

DUAL PURPOSE DISPLAY CASE FOR WRIST WATCH AND OTHER JEWELRY

BACKGROUND OF THE INVENTION

1. Field of the Invention

The invention concerns a display case for wrist watches and other jewelry capable of serving as a storage for non-jewelry items.

2. Related Art

Jewelry display cases, such as those in which wrist watches are sold, have only one function. They serve to hold the wrist watch. After purchase, the case is ordinarily discarded. The disposal is quite wasteful in that the cases are usually of sturdy plastic and expensive in their manufacture. A more environmentally friendly disposal would have social merit.

Accordingly, it is an object of the present invention to provide a jewelry display case which after removal of the jewelry can be serviceable for performance of a function other than its original mission.

Another object of the present invention is to provide a jewelry display case which, after removal of the jewelry, can serve as a holder of CD discs.

Yet another object of the present invention is to provide a jewelry case which can be readily converted for a second alternative use without resort to special tools.

SUMMARY OF THE INVENTION

A jewelry display case, such as to showcase wrist watches, is provided which includes:

a housing including a receiving shell and a cover closeable over the receiving shell;

a display mount within the housing for supporting the jewelry; and a multi-tiered rack within the housing adjacent the display mount.

Jewelry is intended to cover a broad range of personal, artistic, and utilitarian articles. Included within the jewelry term are necklaces, rings, tie clips, cuff links, and tuxedo clips. Most specially, the term, for purposes of this invention, is intended to refer to a timepiece, especially a wrist watch. Display of the jewelry is preferably achieved through a window which may be formed in the cover of the housing.

The display mount of this invention may be formed of wood, rubber, rigid plastic, or flexible or rigid foamed materials. Particularly preferred is flexible polyurethane foam.

In a preferred embodiment, the foamed structure includes an outer foamed frame surrounding a cavity. Form-fittingly engaging the cavity is a foamed support upon which the jewelry may be displayed.

Advantageously, the cover is hingedly attached to the shell. Thereby ready access is achievable to contents of the housing. Upon removing the jewelry and discard of the foamed display mount, the remainder of the case can be utilized for a second purpose. In the preferred embodiment, the second purpose is service of the case as a CD discs storage chamber. The multi-tiered rack has capability of storing anywhere from 2 to 30 discs, particularly from 5 to 15 discs, and optimally from 7 to 12 discs. Tiers of the rack are pivotable from a resting horizontal position to an opened vertical or near vertical position allowing easy access to any of the stored discs.

BRIEF DESCRIPTION OF THE DRAWING

Further objects, features and advantages of the present invention will become more fully apparent through consideration of the following drawing in which.

DETAILED DESCRIPTION OF THE INVENTION

Now there has been developed a display case for jewelry, such as wrist watches, where the case can later be recycled for an alternate use. In the preferred embodiment, the alternate use is service as a CD disc (e.g., music recordings) storage chamber.

Figure 1:
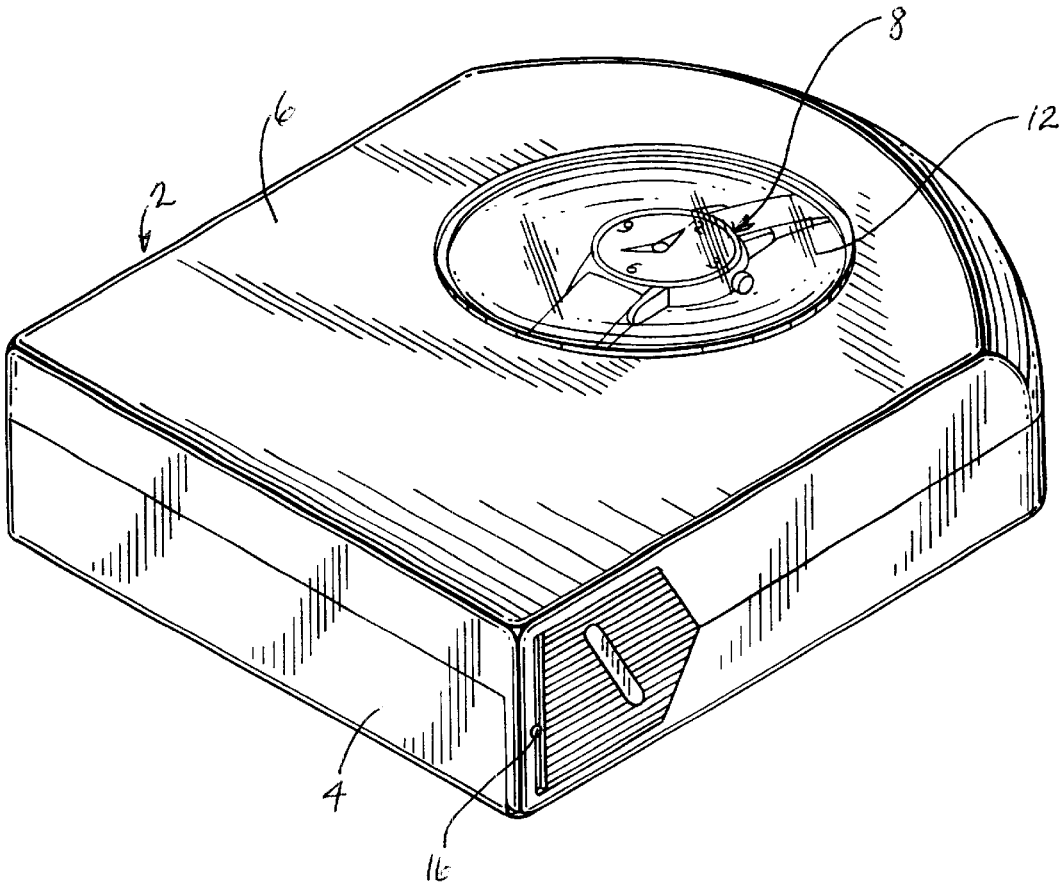
FIG. 1 is a plan perspective view of one embodiment of a display case according to the present invention.
Figure 2:
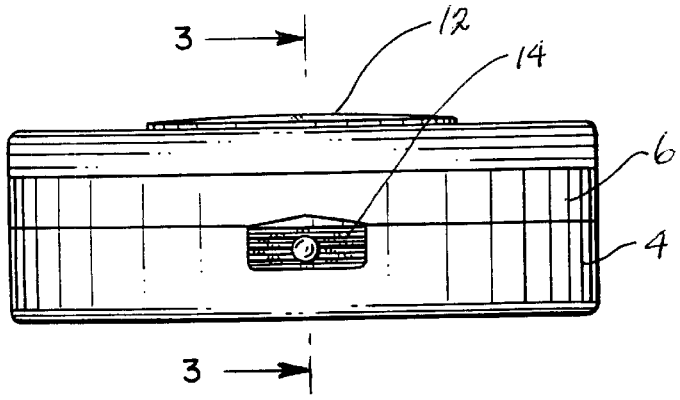
FIG. 2 is a front plan perspective view of the embodiment according to FIG. 1.

FIG. 1 illustrates the display case having a housing 2 including a receiving shell 4 and a cover 6. Within the housing is a wrist watch 8 viewable through a window 12 formed in the housing cover. The wrist watch can be accessed by pressing release button 14 best shown in the FIG. 2 view. Upon release, cover 6 pivots upward through a hinge 16 pivotable along pinion 18.

Figure 3:
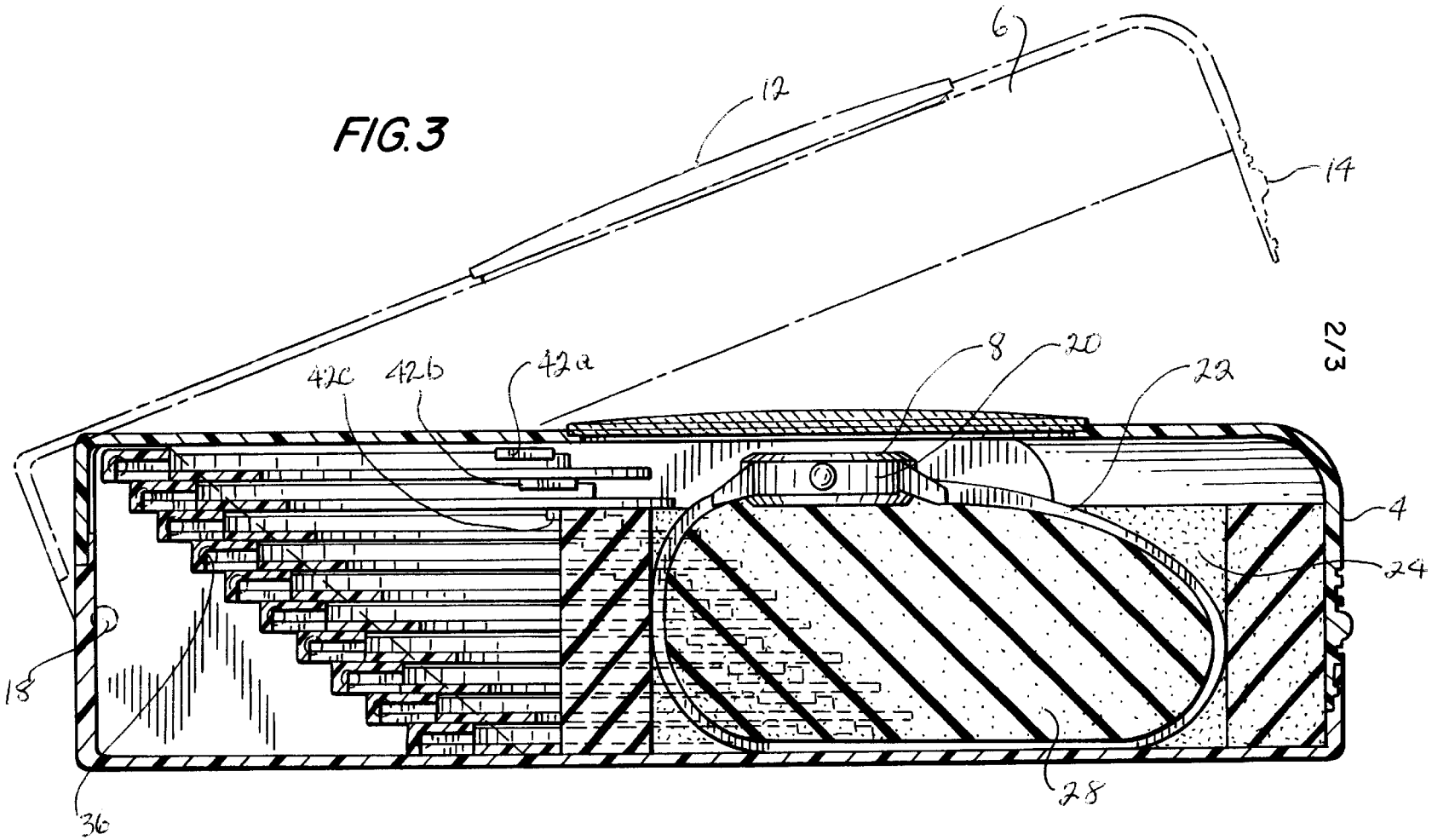
FIG. 3 is a cross-sectional view along line 3—3 of FIG. 2.
Figure 4:
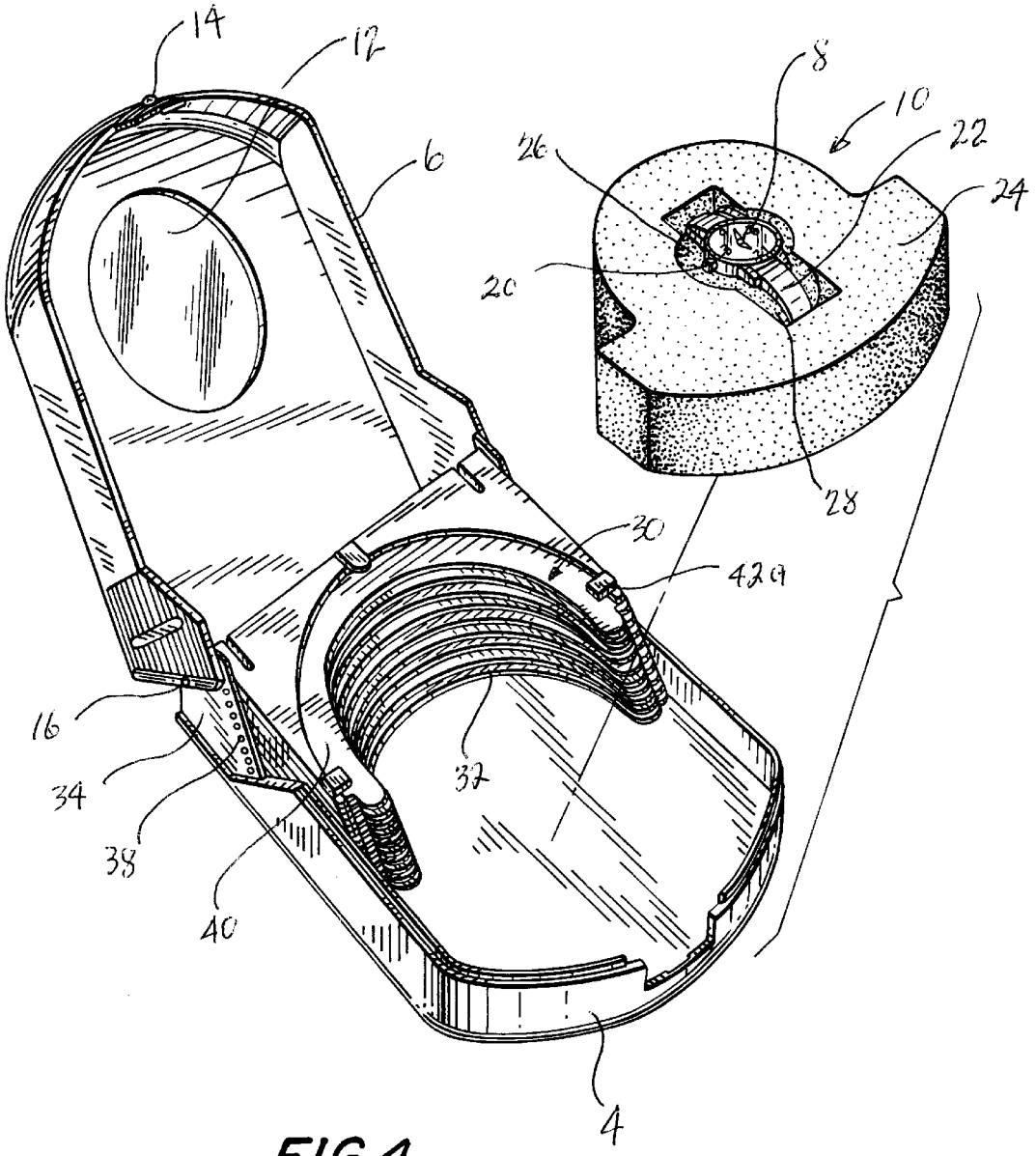
FIG. 4 is an exploded view of the display case according to FIG. 1 demonstrating placement of a wrist watch on a foamed display mount adjacent a multi-tiered rack for storing CD discs.

FIG. 3 illustrates in a cross section the wrist watch 8 with timepiece 20 held by a wristband 22. The display mount 10 is in the preferred embodiment a foamed structure which includes an outer foamed frame 24 surrounding a cavity 26. Within the cavity is a form-fitting foamed support 28 engageable within the cavity and upon which the wrist watch is displayed. Wristband 22 is stretched along the circumference of support 28 to anchor the same within the cavity 26.

Approximately half of the receiving shell is occupied by a multi-tiered rack 30 for performance of a function other than the jewelry display function. In some embodiments, the area utilized within the receiving shell for the second function may range from as low as 10% to as high as 90% of the area. A series of plates 32 form the tiered rack. Each plate is pivotally connected to left and right brackets 34 positioned on either side of the receiving shell. Pivotal connection is made through a pinion 36 moving outwardly from each plate lodging within an aperture 38 of respective left and right brackets. A series of ten apertures 38 are diagonally aligned along each of the brackets to receive respective pinions from each of the respective plates. The pinion/aperture allows each plate to move from a horizontal storage position into a vertical disc dispensing position.

Plate 32 includes a semi-circular shelf 40 on which a CD disc is supported. Movement is restricted by a set of equally distantly placed fingers 42*a,* 42*b,* 42*c* projecting inwardly towards one another and parallel to the shelf. Top surfaces of each of the three fingers serves as a support contact point for a next higher positioned plate.

Additional advantages and modifications will readily occur to those skilled in the art. Therefore, the invention, in its broader aspect, is not limited to the specific details and representative configurations shown and described herein. Accordingly, various modifications may be made without departing from the spirit and scope of the general inventive concept as defined by the appended claims and their equivalents.

What is claimed is:

1. A jewelry display case comprising:

a housing comprising a receiving shell and a cover closeable over the receiving shell;

a display mount within the housing for supporting jewelry; and a multi-tiered rack within the housing adjacent the display mount, the multi-tiered rack comprising a plurality of plates oriented parallel to one another wherein each plate includes a pinion rotating within an aperture.

2. The case according to claim 1 wherein the jewelry is a timepiece.

3. The case according to claim 1 wherein the jewelry is a wrist watch.

4. The case according to claim 1 further comprising a window formed in the housing for allowing viewing of the jewelry.

5. The case according to claim 4 wherein the window is formed in the cover of the housing.

6. The case according to claim 1 wherein the display mount is a foamed structure.

7. The case according to claim 6 wherein the foamed structure comprises an outer foamed frame surrounding a cavity, the cavity formed-fittingly engaging a foamed support upon which the jewelry is displayed.

8. The case according to claim 1 wherein the cover is hingedly attached to the shell.

9. The case according to claim 1 wherein the rack is pivotably moveable from a first to a second position.

10. A jewelry display case comprising:

a housing comprising a receiving shell and a cover closeable over the receiving shell;

a display mount within the housing for supporting jewelry; and a multi-tiered rack within the housing adjacent the display mount, the multi-tiered rack comprising a plurality of plates oriented parallel to one another wherein each of the plates comprises a semi-circular shelf.

11. The case according to claim 10 further comprising a plurality of fingers projecting inwardly over the shelf thereby forming a pocket for holding a flat article.

12. The case according to claim 11 wherein the flat article is a CD disc.

* * * * *